US005592906A

United States Patent [19]

Kreuter et al.

[11] Patent Number: 5,592,906

[45] Date of Patent: Jan. 14, 1997

[54] METHOD AND DEVICE FOR VARIABLE VALVE CONTROL OF AN INTERNAL COMBUSTION ENGINE

[75] Inventors: Peter Kreuter; Joachim Reinicke-Murmann; Peter Heuser, all of Aachen, Germany

[73] Assignee: Meta Motoren- und Energie-Technik GmbH, Herzogenrath, Germany

[21] Appl. No.: 392,983

[22] PCT Filed: Jul. 6, 1994

[86] PCT No.: PCT/DE94/00786

§ 371 Date: Mar. 3, 1995

§ 102(e) Date: Mar. 3, 1995

[87] PCT Pub. No.: WO95/02116

PCT Pub. Date: Jan. 19, 1995

[30] Foreign Application Priority Data

Jul. 6, 1993 [DE] Germany ..... 43 22 480.6

[51] Int. Cl.[6] ..... F01L 1/18; F01L 13/00

[52] U.S. Cl. ..... 123/90.16; 123/90.17

[58] Field of Search ..... 123/90.15, 90.16, 123/90.17, 90.27, 90.39, 90.4, 90.41, 90.43, 90.46, 90.6

[56] References Cited

U.S. PATENT DOCUMENTS

| | | | |
|---|---|---|---|
| 4,535,733 | 8/1985 | Honda | 123/90.17 |
| 4,546,735 | 10/1985 | O'Neal | 123/90.17 |
| 4,724,822 | 2/1988 | Bonvallet | 123/90.16 |
| 4,917,058 | 4/1990 | Nelson et al. | 123/90.17 |
| 5,052,350 | 10/1991 | King | 123/90.16 |
| 5,178,105 | 1/1993 | Norris | 123/90.15 |

FOREIGN PATENT DOCUMENTS

| | | |
|---|---|---|
| 885719 | 2/1981 | Belgium . |
| 3531000 | 8/1986 | Germany . |
| 3519319 | 12/1986 | Germany . |
| 3800347 | 9/1988 | Germany . |
| 3833540 | 4/1990 | Germany . |
| 4104872 | 7/1993 | Germany . |

*Primary Examiner*—Weilun Lo
*Attorney, Agent, or Firm*—Robert W. Becker & Associates

[57] ABSTRACT

A method and a device for the variable control of a valve of an internal combustion engine, in particular for a throttlefree load control of an Otto carburetor engine via a lift function of one or several intake valves per cylinder are presented. Thereby the cams of two camshafts which normally rotate at the same speed are followed by a feeler-device in the manner of an adder and the movement of the feeler-device is transferred to an actuating device for actuating the valve. The cams of one of the camshafts which operates as the opening camshaft is provided with a flat section and a lobe which pass into each other via an opening portion. The cam of the other one of the camshafts which operates as the closing camshaft is provided with a lobe and a flat section which pass into each other via a closing portion. For altering the lift and/or opening duration of the valve the phase relationship between the camshafts is changeable. The feeler-device is, after the closing of the valve, held in contact with the cam of only one of the camshafts, and through this the actuating device is held in contact with the valve. The cam of the other camshaft gets out of contact with the feeler device after the closing of the valve and at the beginning of opening of the valve again gets into contact with the feeler device.

34 Claims, 17 Drawing Sheets

METHOD AND DEVICE FOR VARIABLE VALVE CONTROL OF AN INTERNAL COMBUSTION ENGINE

BACKGROUND OF THE INVENTION

The present invention relates to a method and apparatus for the variable control of a valve of an internal combustion engine, especially for the throttle free load control of an Otto carburetor or reciprocating engine via the lifting or stroke function of one or more intake valves per cylinder.

The advantages of a variable valve control for internal combustion engines have been known for a long time. By variably controlling the charge valves the torque curve can be improved or the maximum power can be increased. Also, the raw emissions can be decreased or the losses of charges can be significantly reduced, if the charge and/or load control takes place without using a throttle valve but only by the variation of the lift or opening duration of the inlet or intake valves. Correspondingly there are numerous suggestions in the literature for a variable valve control of internal combustion engines.

In the generic BE-PS 885.719 an opening camshaft and a closing camshaft cooperate with a rocker arm which is supported on the valve stem of an intake valve. In order for the rocker arm to maintain a defined position when the intake valve is closed a spring is provided which continuously presses the rocker arm against the cams of both camshafts. Thereby the rocker arm temporarily withdraws from the valve stem. This renders the application of an automatic valve clearance compensation considerably difficult. Furthermore, both camshafts are permanently in a friction contact with the valve rocker which increases the friction losses of the valve drive.

DE 35 31 000 A1 describes a device for the decrease of throttle losses with piston engines under partial load by means of phase control of the valves whereby a rocker lever is supported on a valve stem and its two ends cooperate with a respective camshaft. A characteristic of this cam drive is that each time only half the lift of a cam can be taken advantage of and the opening and closing movements of the valves are determined by the contours of the two cams by means of which unacceptably high accelerations may occur.

A further suggestion for a variable valve control for a lifting cylinders combustion engine can be found in DE 35 19 319 A1. With this variable valve control an intake valve can be actuated by a rotating lift camshaft by means of a valve lever which can be pivotable about a slidable bearing against the force of a valve spring. A control camshaft that rotates at the same speed as the lift camshaft additionally engages the valve lever and controls the pivoting movement of the lever as a function of operating parameters of the internal combustion engine. A characteristic of this known valve control is that the valve opening or closing movement, as a result of the phase relationship of the lift camshaft and the control camshaft, is determined by the cam contours of both camshafts, by which unacceptably high valve accelerations or speeds can occur on closing when placing the valve into its position, or the maximum rate of revolutions of the combustion engine is unacceptably restricted.

A further device for a variable valve control is described in U.S. Pat. No. 5,178,105. This reference deals with the problem of adjusting the control timings of the valves to different rates of revolutions. For this purpose the device comprises two camshafts, the cams of which are formed mirror-inverted towards each other and respectively pass from a point of minimal lobe via a steep section and a flat section into a point of maximum lobe. The two cams act on a common feeler-element or follower which in cross section is triangular and is pivotably guided directly on a stem of the valve that is to be actuated. The opening and closing phase of the valve is respectively determined by the addition of the lift functions which both cams carry out in respect to the follower, by means of which as a result of the phase relationship of the camshafts the valve movement is alterable in certain limits. As to the design of the cams there are distinct restrictions since in certain phases the follower is shifted by the two cams only relative to the stem without a resulting lift movement of the valve. Furthermore, the closing position of the follower is a result of the phase relationship of the camshafts which requires a very sophisticated valve adjusting device which, at rapid phase changes, can lead to problems in the valve drive.

The object of the invention is to create a method for the variable control of a valve of an internal combustion engine, in particular for the throttlefree load control of an Otto carburetor engine via the lift function of one or several intake valves per cylinder, which at high operating reliability unites a cost-efficient manufacturing with the possibility of providing an automatic valve clearance compensation. A further object of the invention is to provide a device for the performance of this method.

SUMMARY OF THE INVENTION

The method of the present invention is characterized by the features of: sensing the cam contours of cams of two camshafts, which normally rotate at the same speed via a feeler or follower means in the manner of an adder; transmitting the movement of the follower means to the valve via an actuating means for actuating the valve; providing one of the camshafts as an opening camshaft having a cam contour with a base portion that merges via an opening portion with a lobe; providing the other of the camshafts as a closing camshaft having a cam contour with a lobe that merges via a closing portion with a base portion; varying the phase relationship between the camshafts to vary the lift and/or opening duration of the valve; after closure of the valve, holding the follower means in contact with the cam of only of the chamshafts, while the cam of the other of the camshafts moves out of contact with the follower means and again comes into contact with the follower means at the latest at the beginning of opening of the valve; and when the valve is in a closed state, holding the actuating means at least nearly in contact with the valve. With these features it is achieved that one cam, after the closing of the valve, is released from the follower so that the necessary friction is reduced. Furthermore, the cam of the camshaft which gets out of contact with the follower after the closing of the valve can be manufactured very cost-efficiently in the section with which it does not get into contact with the follower and provides additional freedom as to the design of the effective cams. Because of the fact that the actuating device is constantly being held in contact with the valve, the application of an automatic valve clearance compensating device is possible in a simple way. The apparatus of the present invention is characterized by: two camshafts that normally rotate at the same speed, the camshafts being provided with cams having cam contours, wherein the cam contour of one of the camshafts that operates as an opening camshaft is provided with a base portion that merges via an opening portion with a lobe, and wherein the cam contour of the other of the camshafts that operates as a closing camshaft is provided with a lobe that merges via a closing portion with a base portion; feeler or follower means for sensing the cam contours of the camshafts in the manner of an adder; an actuating means for transmitting movement of the follower means to the valve or actuating the valve; means for varying the phase relationship between the camshafts to vary the lift and/or opening duration of the valve; spring means for holding the follower means, after closure of the valve, in contact with the cam of only one of the camshafts; and means for holding the actuating means, when the valve is in a closed state, at least nearly in contact with the valve.

Further specific features of the present invention will be described in detail subsequently.

BRIEF DESCRIPTION OF THE DRAWINGS

The object of the present invention, and other objects and advantages thereof, will appear more clearly from the following description in conjunction with the accompanying schematic drawings of exemplary embodiments, in which.

It is shown in.

DESCRIPTION OF PREFERRED EMBODIMENTS

Figure 1:
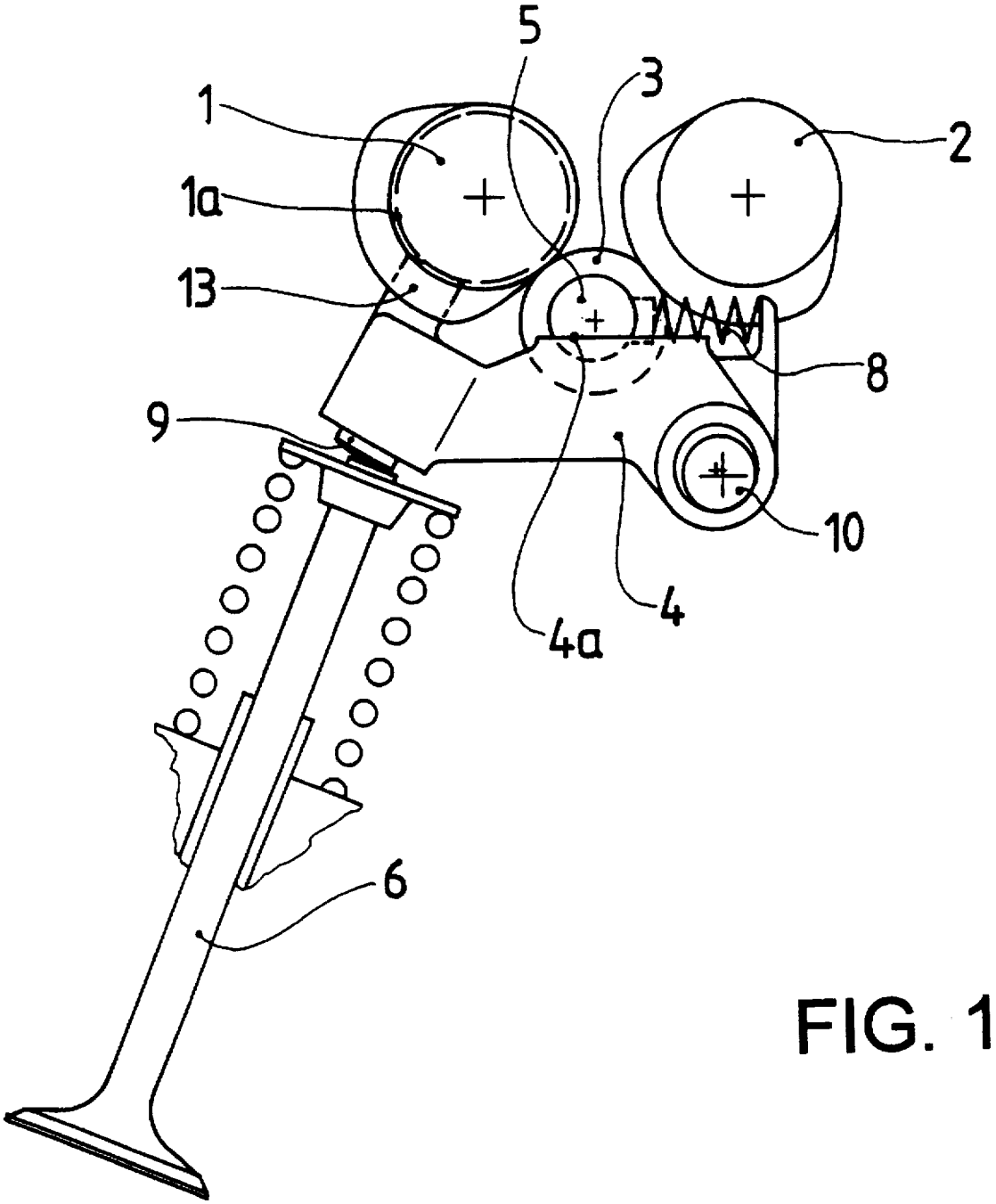
FIG. 1 a schematic side view, partly sectional, of a device for the variable control of at least one valve, FIG. 2 a plan view of an advantageous embodiment of a feeler-element or follower for operation in the device according to FIG. 1, FIG. 3 schematic views of the arrangement of the camshafts for a follower according to FIG. 2, FIGS. 4*a*, 4*b* through 7 views according to FIG. 1 with different operating positions in order to illustrate the functioning of the device according to FIG. 1, FIG. 8 an embodiment of the device, altered in respect to FIG. 1, FIG. 9 a schematic view of a further embodiment of an inventive device, FIG. 10 a further development of the device, schematically illustrated in FIG. 9, FIG. 11 a further development of the device according to FIG. 10, FIGS. 12*a*, 12*b* a further development of the device according to FIG. 10 in perspective illustration with a device for stopping valves, FIG. 13 a further development of the device according to FIG. 1 with a device for stopping at least one valve, FIG. 14 a plan view of a feeler- and actuating device for usage in the device according to FIG. 13, FIG. 15 an embodiment of the inventive device with which additional valves can be actuated, and FIG. 16 a further development of a device with which additional valves can be actuated.

According to FIG. 1 the inventive device for the variable valve control of internal combustion engines comprises two camshafts 1 and 2 which rotate at the same speed, the cams or cam discs of which both act on a feeler-element or follower 3. The overlapping of the lift function of the two cam discs causes a corresponding movement of the follower 3 which is transmitted to the valve 6 via one or several transmission elements 4. By means of a relative change of the phase relationship of the two camshafts 1 and 2 towards each other by the aid of an appropriate camshaft regulator, not shown here, this lift movement can be varied in a wide range not only in regard to the height of the maximum lift but also in regard to the duration of the valve opening. Such a camshaft regulator is, for example, described in the German patent application P 42 44 550.

The follower 3 can be formed as a cam roller or also in the form of a sliding-block which is provided with appropriate feeler or follower surfaces. The follower 3 is slidably guided or pivoted on the transmission element 4, and the support can be constructed, for example, as a planar or curved slideway/guideway 4*a* or as a pivot member that is rotatable in the transmission element 4. Particularly advantageous is the illustrated embodiment in which a bearing pin 5 (see FIG. 2) of the follower 3, which is formed as a cam roller, is chamfered at its ends so that an appropriate counter surface is provided in relation to the slideway 4*a* which is mounted on the transmission element. This embodiment also makes a lateral guidance possible which is necessary to prevent a lateral migration of the follower 3.

The transmission element 4 can basically be formed as a rocker arm lever or as a conventional cup tappet. Particularly advantageous is the rocker arm embodiment illustrated in FIG. 1 since it is especially space-saving and by means of a transmission of the follower 3 to the valve 6 can compensate the transmission required by the arrangement on transmitting the cam lobes to the follower 3. Thereby the cams can to a great extent be formed conventionally.

Figure 2:
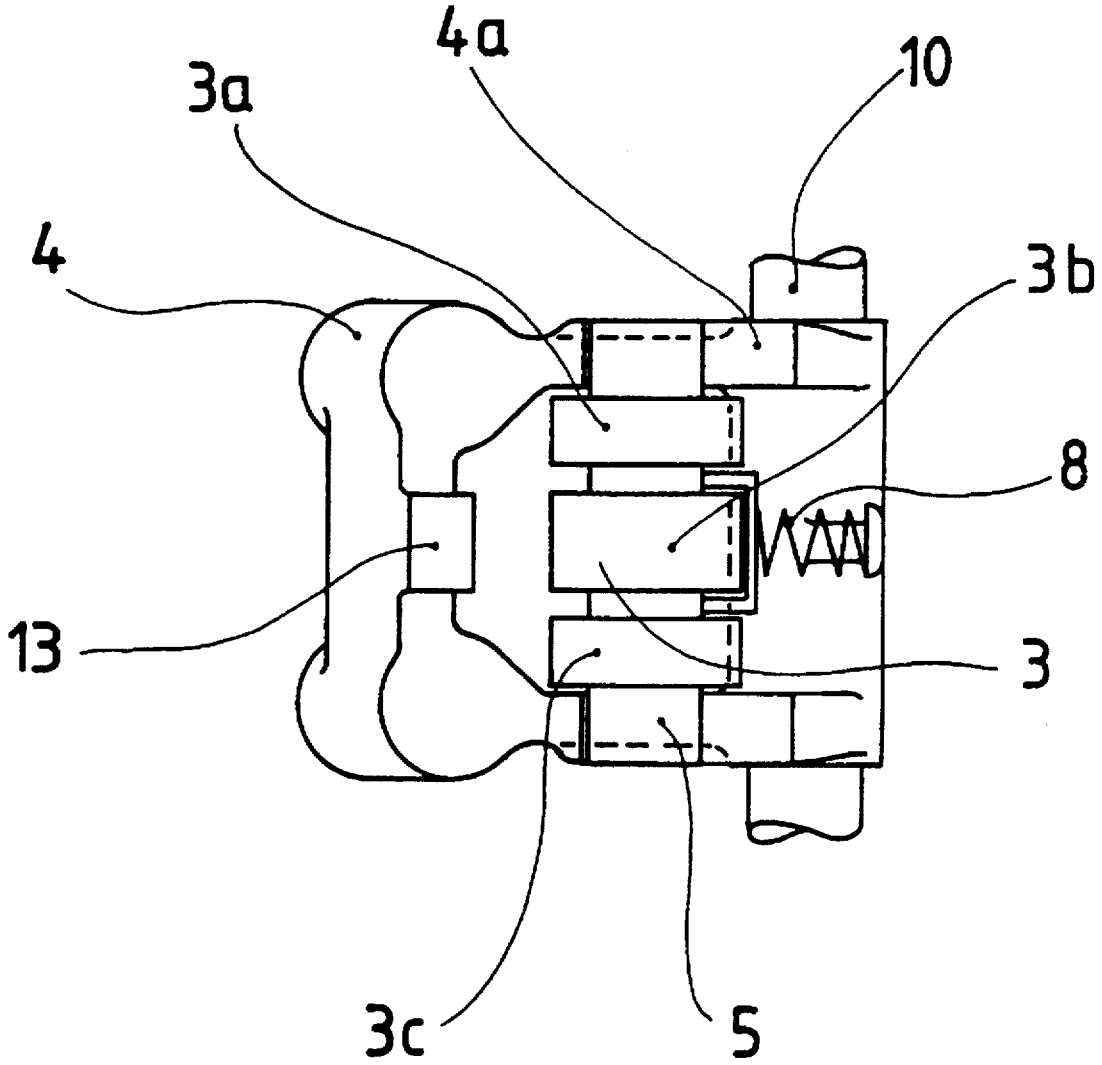

According to FIG. 2 the follower 3 comprises three cam rollers 3*a*, 3*b*, and 3*c* which are mounted on a common pin 5. The two outer rollers 3*a* and 3*c* cooperate with two identical cam discs of one of the camshafts which is not shown in FIG. 2 whereas the inner roller 3*b* cooperates with the cam disc of the other camshaft. By this construction the advantages of the reduction of friction are fully exploited as each cam disc is being followed by a respective cam roller. The arrangement is also very advantageous for the reason that by this means no symmetric momentums act on the mounting pin.

Figure 3:
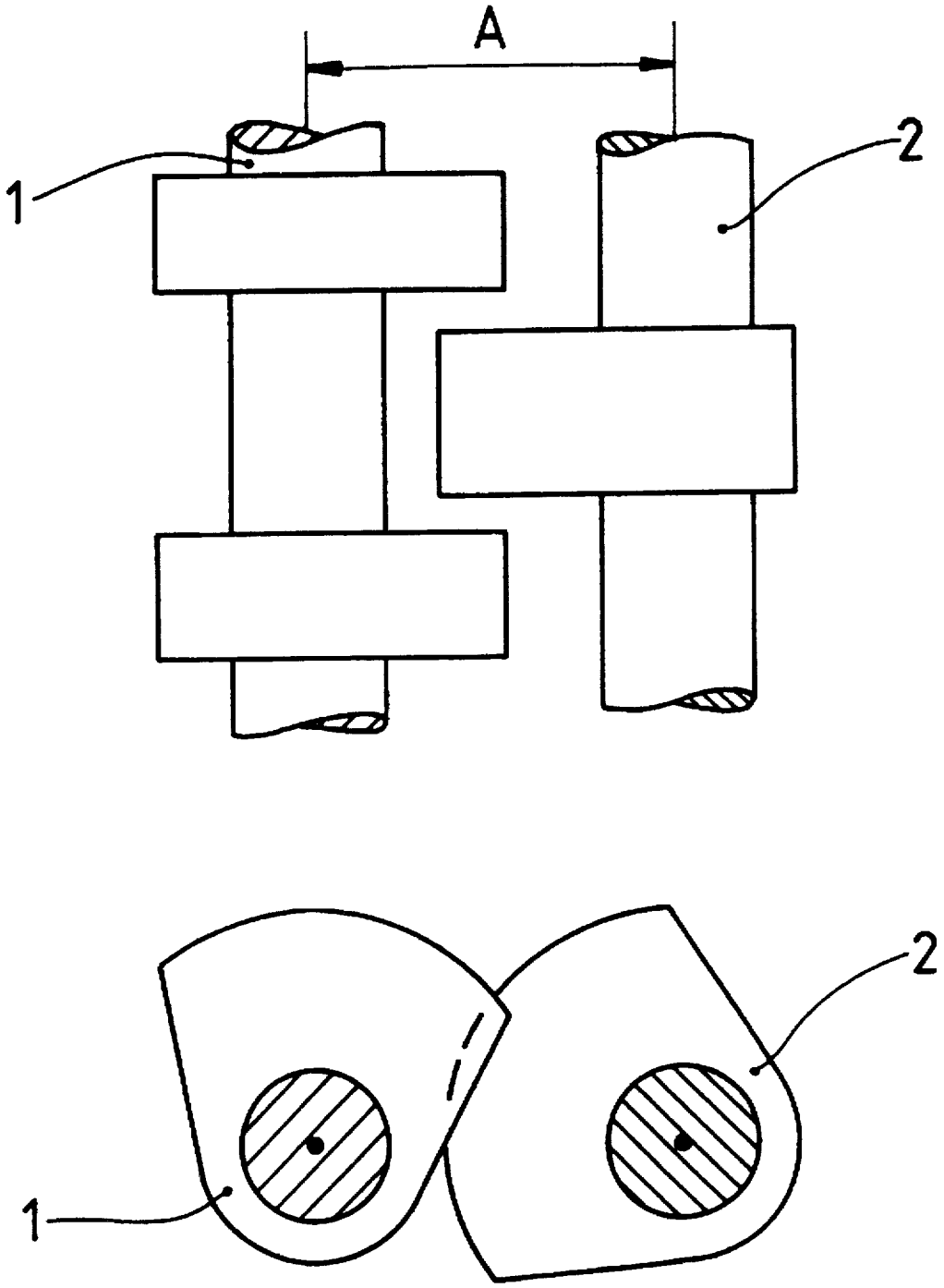

FIG. 3 illustrates a structural design of the camshafts 1 and 2 which is particularly advantageous for the follower 3. They are arranged in such a way that the lift circles of the cam discs of the two camshafts overlap and the cam discs are axially offset in such a way that they do not contact each other. This makes a significant reduction of the space required for the valve drive possible.

Again referring to FIG. 1 a spring 8 is provided for the defined contacting position of the follower 3 to the cam disc(s) of a camshaft; the spring is supported between the follower 3 and the transmission element 4 and, in the illustrated example, is formed as a compression spring.

With the described valve drive a conventional hydraulic clearance compensating element 9 can be mounted in the transmission element if the position of the transmission element(s), when the valve is closed, is defined by the contact of a stop 13 at a cylinder surface 1*a* which is formed concentrically at the camshaft 1 which is near the valve and the diameter of which, in the illustrated example, approximately corresponds to the base circle of the camshaft 1. Through the clearance compensating element 9 the deformation in extension, due to thermal changes, of the valve 6 as well as changes of the position of the valve due to wear of the valve seating are compensated.

Manufacturing tolerances of the described valve drive can be compensated at a first setting when installing the valve drive if a support means 10 of the transmission element(s) which is mounted in a housing is constructed to be continuously variably adjustable, for example by means of an eccentrically supported axis.

In the following the function of the described device is explained with reference to FIGS. 4*a*, 4*b* through 7.

Figure 4A:
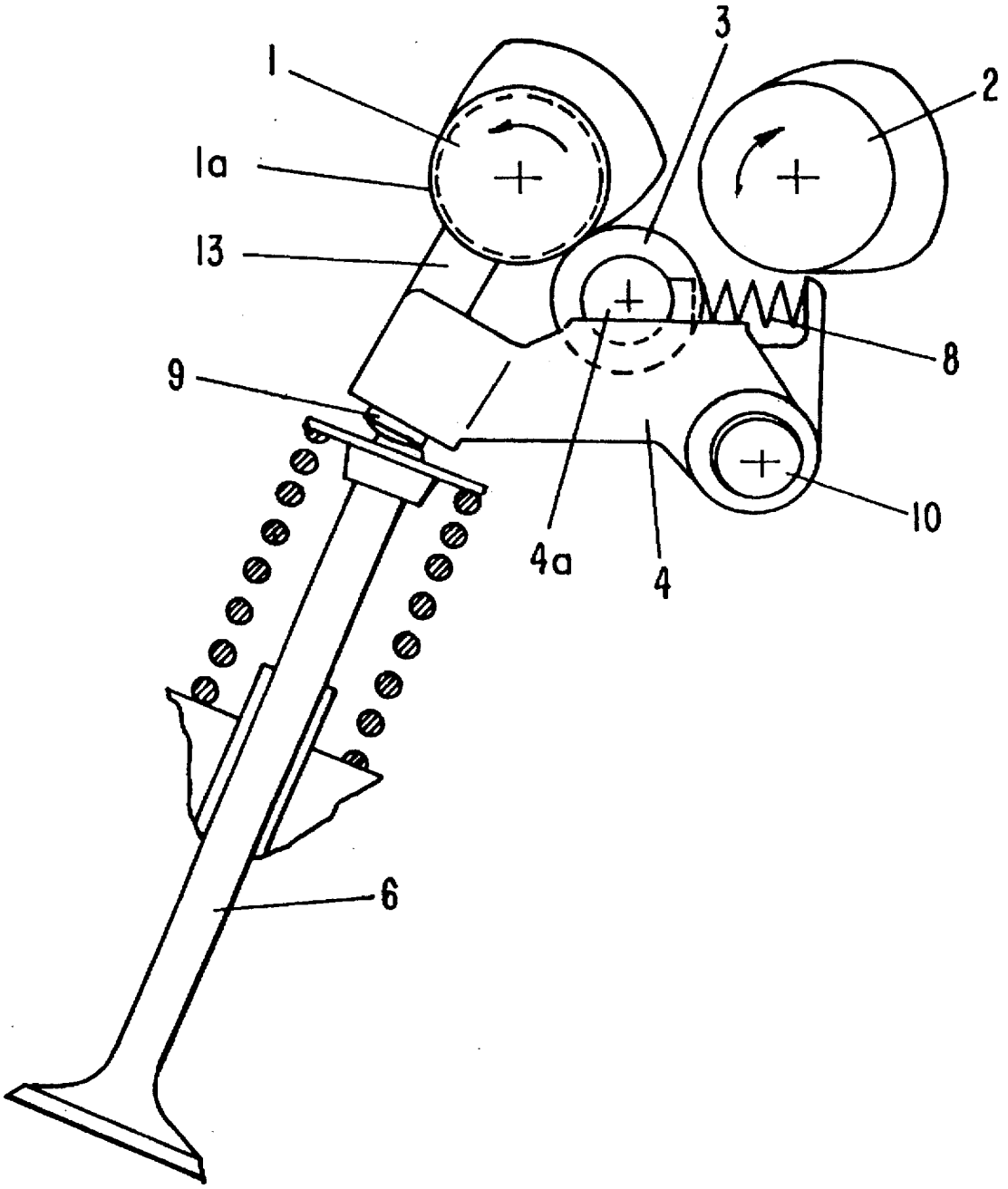
Figure 4B:
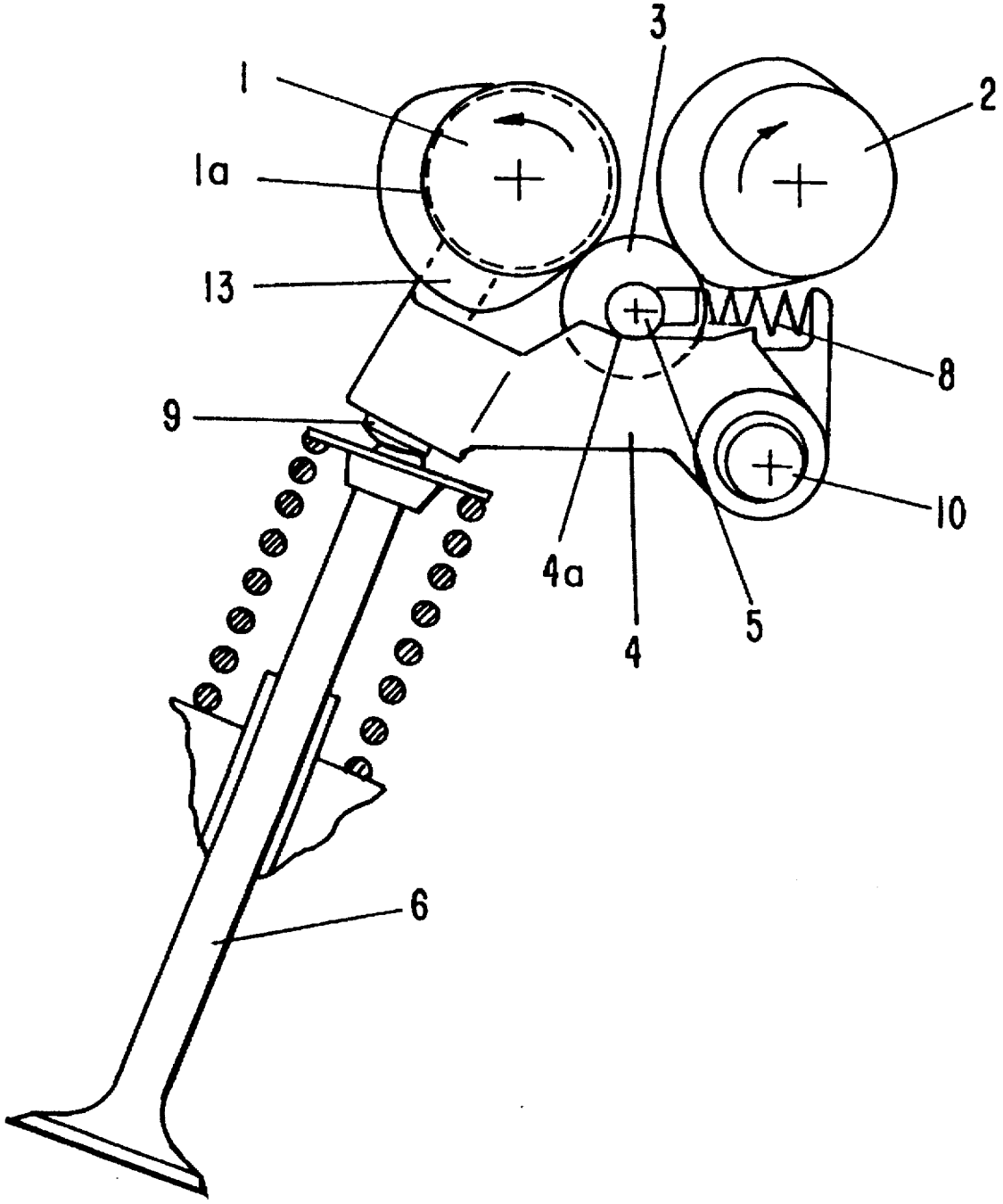

FIGS. 4*a* and 4*b* illustrate the arrangement at a state in which the phase shift between the camshafts 1 and 2 is chosen in such a way that the valve 6 opens only for a very short time and with a low amplitude. This state corresponds to a mostly closed throttle valve of conventional engines.

The camshaft 1 is the opening camshaft in the illustrated, advantageous example. The camshaft 2 is the closing camshaft. The two camshafts rotate, as is indicated by the arrows, in opposing directions and at the same speed, at least as long as the phase adjusting device, which is not shown, is not active. The follower 3 engages or is in contact with the end of the lobe of the cam disc of the camshaft 2 and with the beginning of the opening portion of the cam disc of the opening camshaft 1. The valve 6 is still closed. When the opening camshaft 1 turns further its opening portion comes into contact with the follower 3 as a result of which the transmission element 4 is rotated counterclockwise and valve 6 opens. This opening, however, is carried out only with a low amplitude, since the lobe of the closing camshaft 2 ends and passes into the closing portion which reduces the valve opening and the valve is closed again as soon as the base circle portion of the closing camshaft 2 comes into contact with the follower 3. When the valve 6 is closed the lobe of the opening camshaft 1 runs over the follower 3 and passes into the base portion while the spring 8 constantly pushes the follower 3 into contact with the cam disc of the opening camshaft 1 so that the follower 3 gets out of contact with the cam disc of the closing camshaft 2 when the lobe of the opening camshaft 1 passes into the base portion, and the follower 3 again moves into contact with the closing camshaft 2 when the base portion of the opening camshaft 1 passes into the opening portion.

Since the clockwise rotation of the transmission element 4 is limited by the stop 13 the clearance compensating element can operate in the closing position of the valve 6. The support means 10 is advantageously adjusted in such a way that in the closing position of the valve the follower 3 simultaneously rests against the base portion of the opening camshaft 1 and the lobe of the closing camshaft 2.

Figure 5:
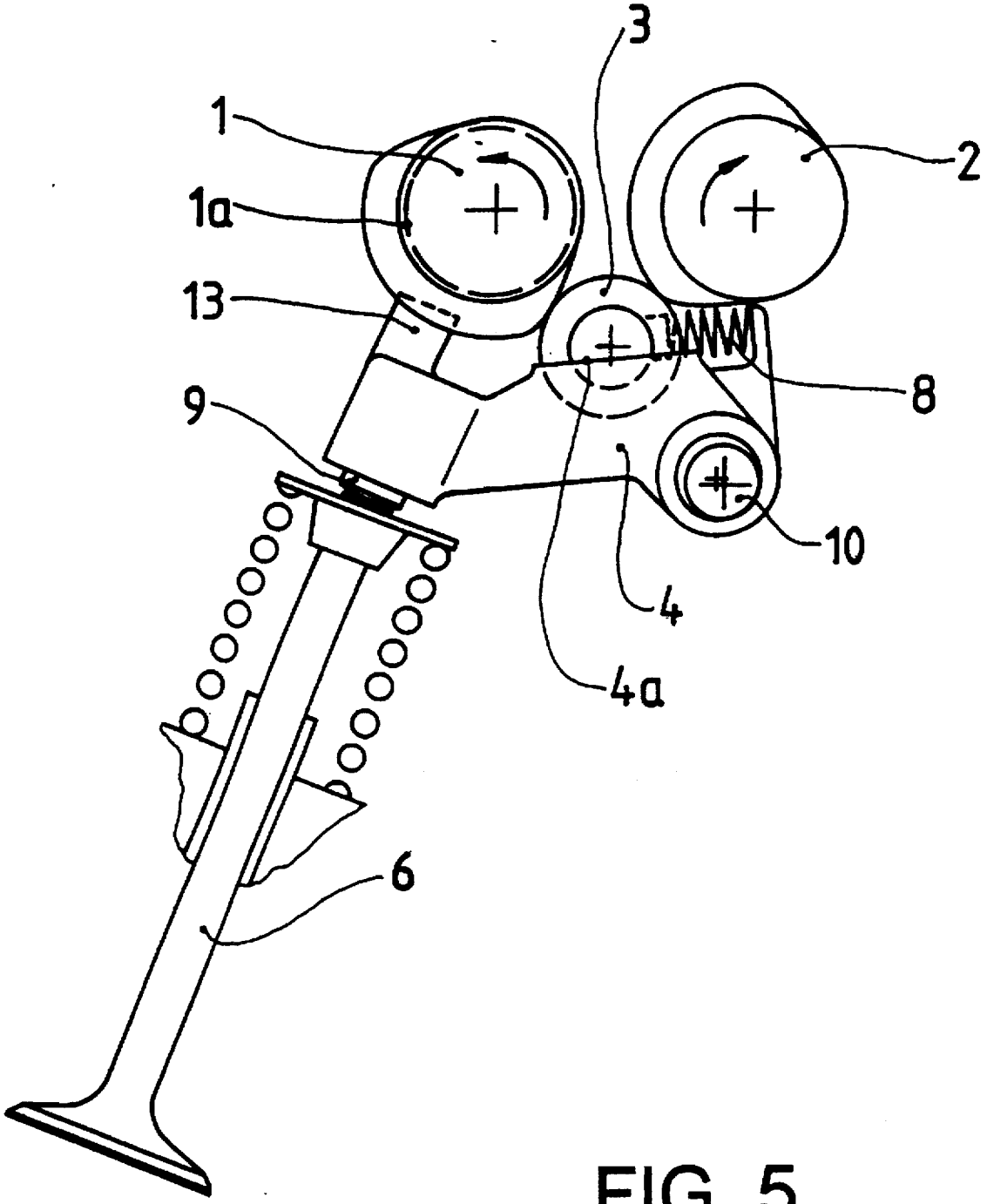

FIG. 5 illustrates the arrangement according to FIGS. 4*a* and 4*b* with the same phase relationship between the camshafts 1 and 2, but rotated further by some degrees, at the beginning of the closing of the valve 6. As is illustrated the opening portion of the opening camshaft 1 which connects its base portion with the lobe has not yet completely passed when the lobe of the closing camshaft 2 ends and passes from its closing portion into the base portion. The closing movement which is caused by this overcompensates the further opening movement so that the valve 6 is closed as soon as the base portion of the closing camshaft 2 is reached. When the lobe of the opening camshaft 1 has run over the follower 3 and passes into the base portion of the opening camshaft the follower 3 withdraws from the base portion of the closing camshaft 2 by aid of the spring 8 and only gets into contact again with its lobe.

Figure 6:
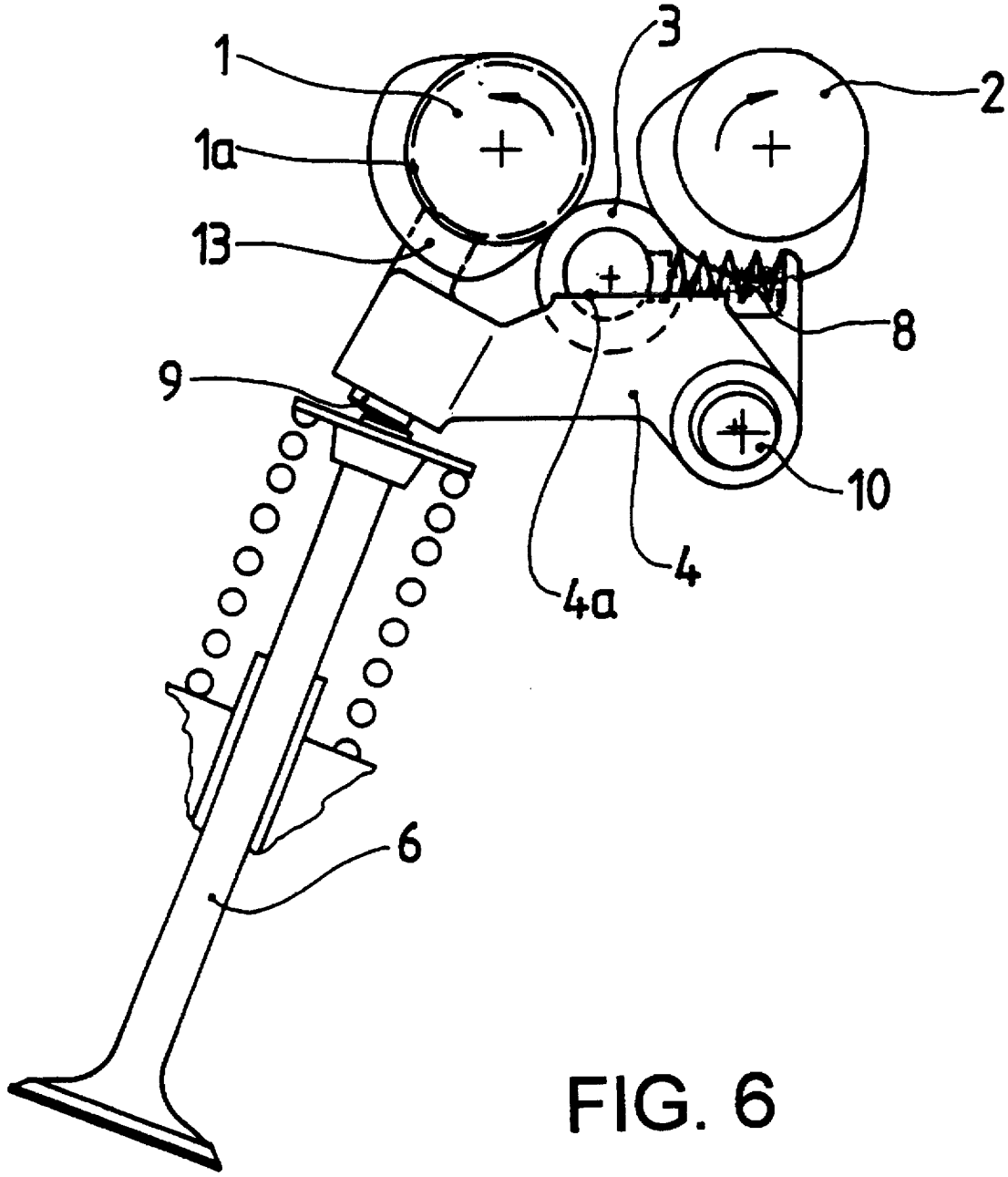
Figure 7:
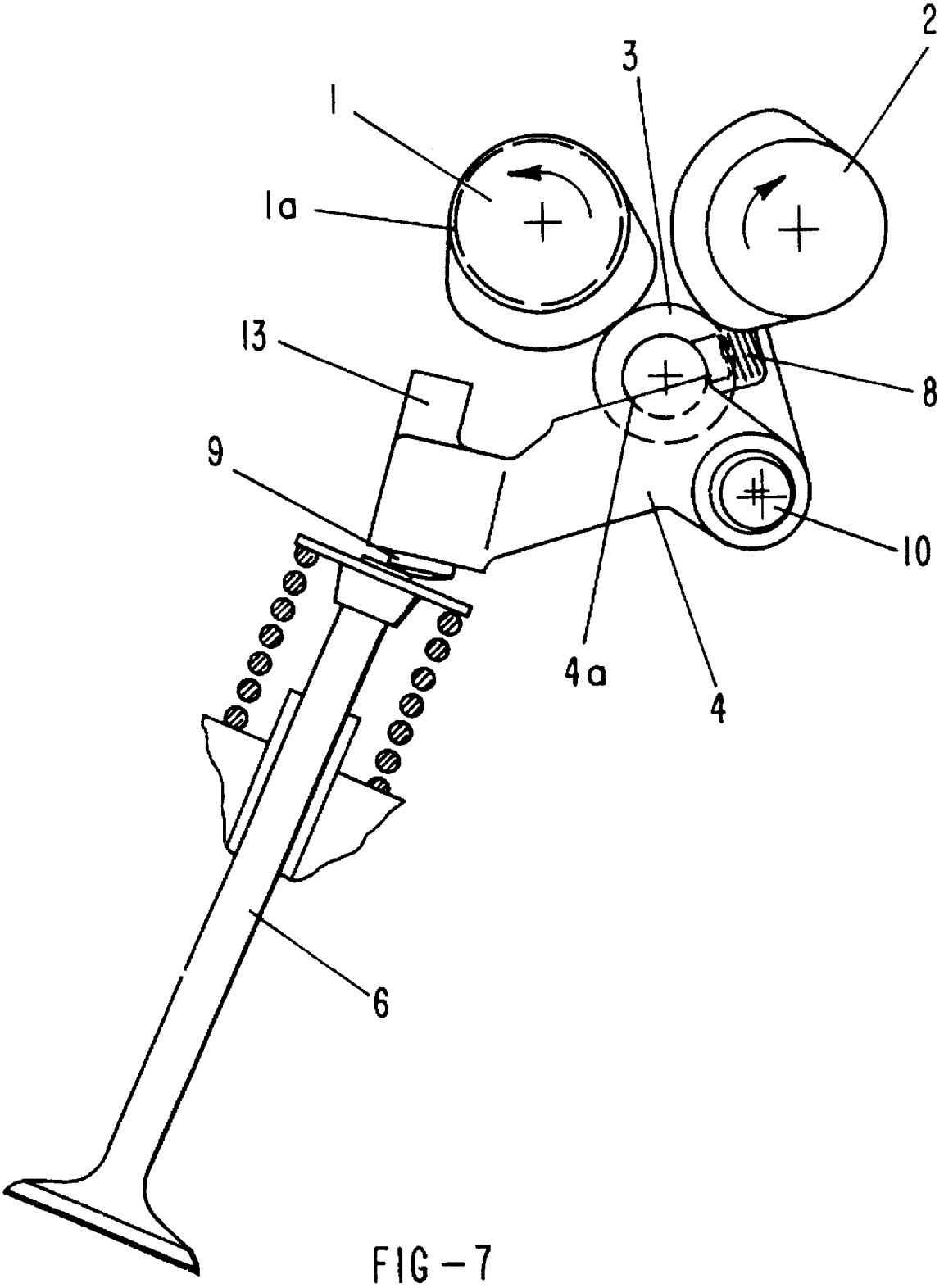

FIG. 6 illustrates the arrangement according to FIGS. 4*a* and 4*b* with a changed phase relationship between the camshafts 1 and 2; the illustrated phase relationship corresponds to the full load, i.e. to a fully opened throttle valve of a conventional engine. As is illustrated, the end of the base portion of the opening camshaft 1 is in contact with the follower 3 which also is in contact with the lobe of the closing camshaft 2 which is not yet passed by half. When the opening camshaft 1 rotates further the opening portion of the cam disc of the opening camshaft 1 which connects the base portion with the lobe comes into contact with the follower so that the valve 6 opens while the follower 3 is still in contact with the lobe of the closing camshaft 2. The valve 6 then stays open while the lobe of the opening camshaft 1 runs over the follower 3 until the end of the lobe of the closing camshaft 2 is reached and the position according to FIG. 7 is given which illustrates the closing begin at full load. With the follower still in contact with the opening portion of the opening camshaft 1 the closing portion of the closing camshaft 2 is being passed which connects its lobe with the base portion and causes the closing of the valve 6. When the end of the lobe of the opening camshaft 1 is reached the follower 3, aided by the spring 8, moves away from the cam of the closing camshaft 2 and only gets into contact with it again when the lobe of the closing camshaft 2 is reached while the follower 3 is still in contact with the base portion of the opening camshaft.

As explained, the movement, i.e. particularly the maximum acceleration of the valve 6 in the opening direction is exclusively effectuated by the opening portion of the opening camshaft 1 which connects its base portion with the lobe. The closing movement of the valve 6 is caused by the closing portion of the closing camshaft 2, which connects its lobe with the base portion, in such a way that the maximum closing acceleration and closing speed are exclusively determined by the closing portion. The section of the closing camshaft 2 which, in rotating direction, is the connection between the base portion and the lobe does not come into contact with the follower 3 since, in the operating phase in which this section is positioned next to the follower 3, it gets pushed away from contacting the closing camshaft 2 by the spring 8. This has an effect towards a reduction of friction of the valve drive and moreover makes a very cost-efficient processing of the closing camshaft 2 possible.

The entire arrangement can be built extremely compact and space-saving and additionally is extremely simple in its construction. The design of the opening portion of the opening camshaft 1 and of the closing portion of the closing camshaft 2 largely corresponds to those of conventional cams, i.e. the maximum accelerations of the valve 6 in the critical operating areas range in similar sizes as are conventional valve drives by which means an excellent functional reliability and longevity are achieved. A wide freedom exists in regard to the more detailed design of the cam contours which again renders possible a good adjustment of the effective opening and closing principles of the valve 6 in relation to the respective requirements such as rate of revolutions and load of the internal combustion engine; in particular the cam contours can be designed in such a way that, as is illustrated in FIG. 7, the valve can be opened at maximum lift over a greater angular range through which a significant increase in performance at high rates of revolutions can be realized.

The phase change mechanism for the camshafts 1 and 2 is not an object of the present invention and therefore is not being explained in detail. Advantageously the opening camshaft 1 is driven by the crankshaft of the internal combustion engine and the opening camshaft 1 drives the closing camshaft 2, between the two of which the phase change mechanism is positioned. It is understood that depending upon the operating requirements the phase relationship of the camshaft 1 in relation to the crankshaft can be changed to the required dimension by means of a further phase change device in a way which is known per se.

Figure 8:
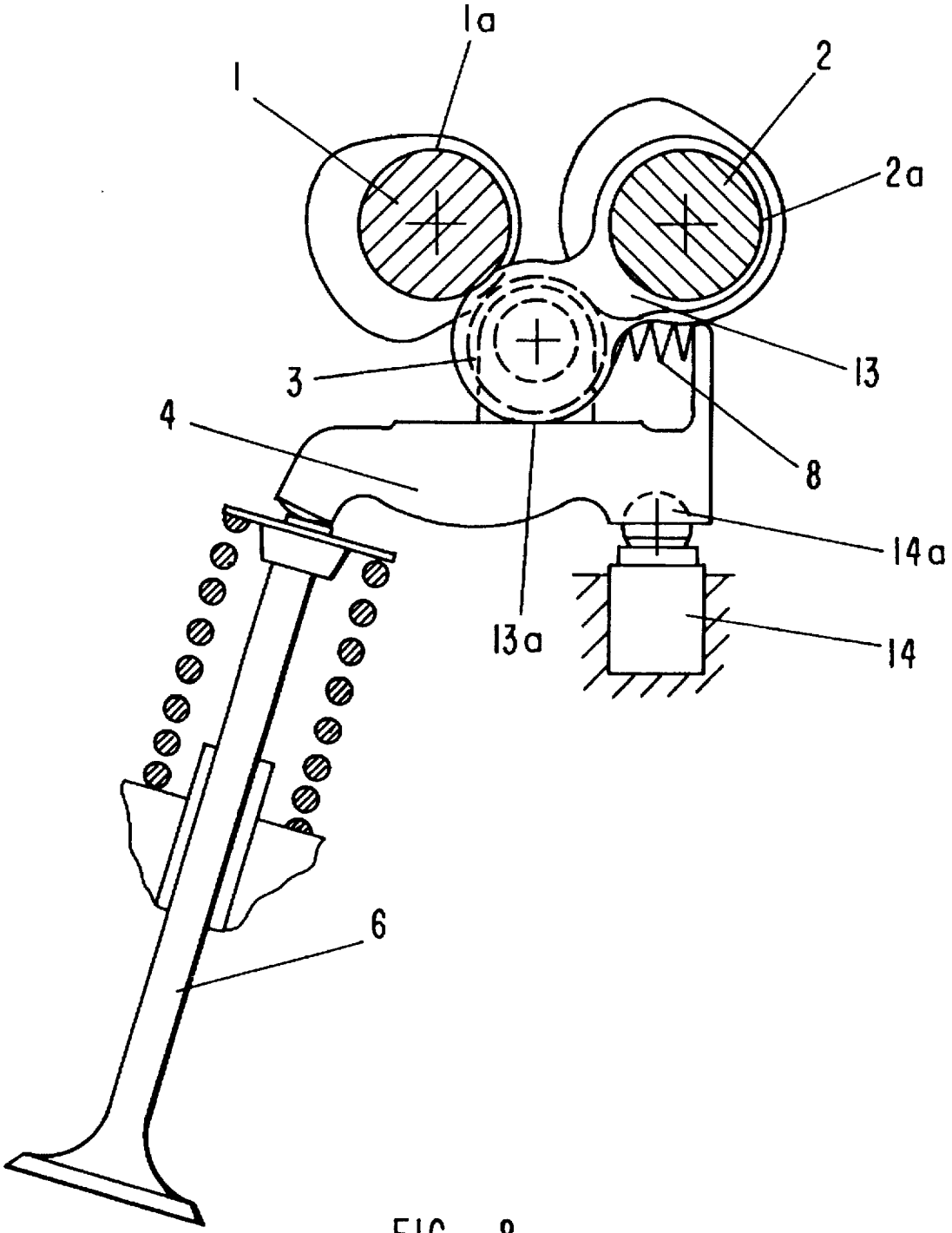

FIG. 8 illustrates an embodiment of the inventive device which is altered in respect to FIG. 1. In this embodiment the stop 13 of FIG. 1 is missing as well as the continuously variable support means 10 of FIG. 1. In contrast to the embodiment according to FIG. 1 an additional stop 13 is supported at a cylinder surface 2*a* of the camshaft 2 and ends in a circular body 13*a*, the diameter of which approximately corresponds to that of the follower 3. Just like the follower 3 the circular body 13*a* is supported on the transmission element 4. The circular body 13*a*, however, additionally rests, when the valve 6 is closed, against a cylinder surface 1*a* which is formed at the camshaft 1. The transmission element 4 is supported on a spherical head 14*a* of a hydraulic clearance compensating element 14 that is known per se. Advantageously the radius of the cylinder surface 1*a* approximately corresponds to the radius of the base circle or base area of the cam disc of the camshaft 1, and the radius of the cylinder surface 2*a* approximately corresponds to that of the base area of the respective cam disc. By the described arrangement it is achieved that the only clearance compensating element 14 not only compensates, by the combined action of the transmission element 4 with the circular body 13*a*, the contact of the latter with the cylinder surface 1*a* and its support at the cylinder surface 2*a*, possible manufacturing tolerances of the inventive device but also a valve clearance which is caused by thermal changes or wear. For the functioning of the described arrangement not only the indicated sizes of the cylinder surfaces 1*a* and 2*a* are advantageous but it is also advantageous if the diameter of the circular body 13*a* approximately corresponds to that of the follower 3, i.e. its cam rollers 3*a*, 3*b*, and 3*c*. Alternatively to the embodiment according to FIG. 8, instead of the stop 13 also a sliding block can be provided which is supported on the transmission element 4 and is in contact with both cylinder surfaces 1*a* and 2*a* when the valve 6 is closed.

Figure 9:
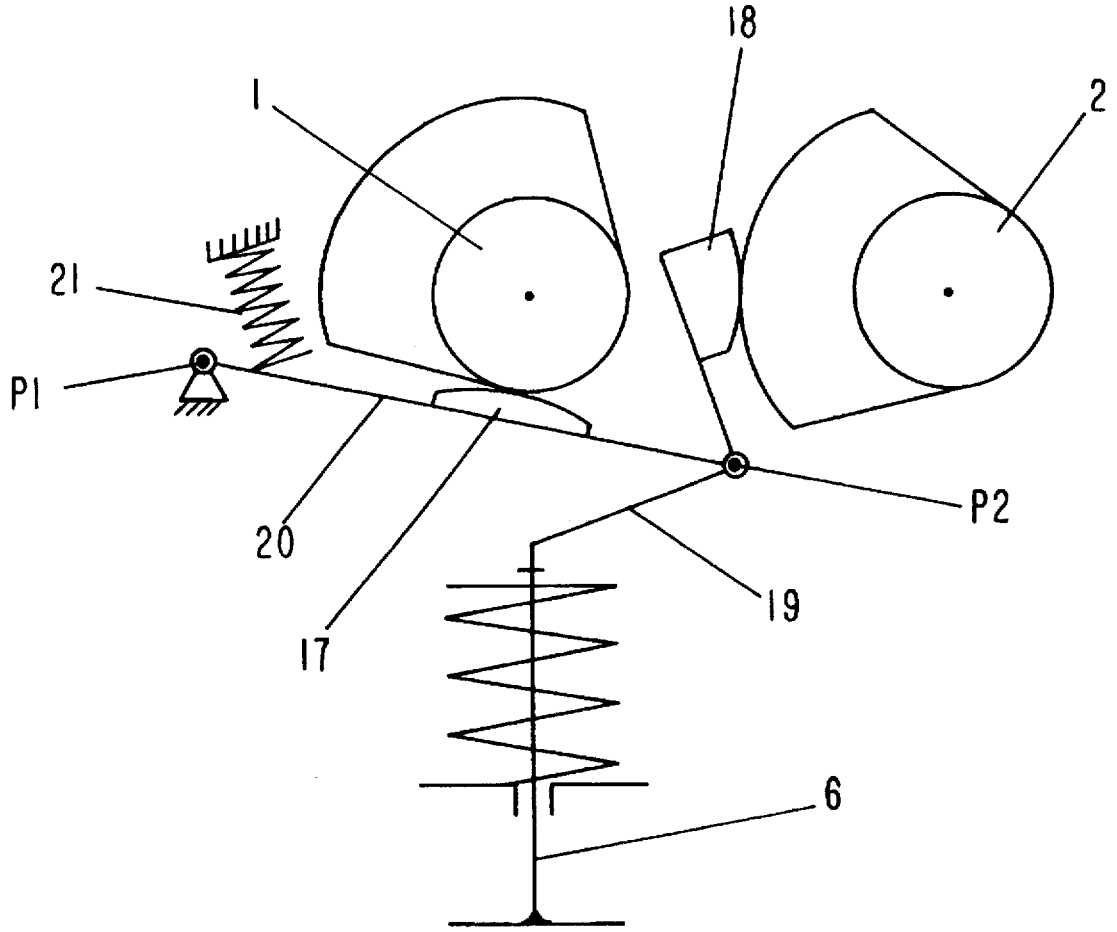

FIG. 9 illustrates an altered embodiment of the device. The cam discs of the two camshafts 1 and 2 there contact the followers 17 and 18, in which case the camshaft 1 preferably is the closing camshaft and the camshaft 2 is the opening camshaft. The follower 18 is provided with a rocker arm which actuates the valve 6. At P2 the rocker arm 19 is supported on an articulated or mounted lever 20 which carries the other feeler or follower device 17 and at P1 is fixedly supported. A spring 21 which, in the illustrated example, is formed as a compression spring ensures that the follower 18 stays in a constant contact with the cam of the camshaft 2 and the rocker arm 19 is in a constant contact with the valve 6.

The described embodiment of the device has the advantage that the mobile structural parts of the valve drive in regard to their type of structure and their kinematical effect can basically be formed like corresponding conventional valve drive structural parts and do not require a larger space either. The followers 17 and 18 can, for example, be formed as sliding blocks or as cam rollers. The function of the described device is on the whole similar to the one of FIG. 1, and the lift and opening duration of the valve 6 can again be widely varied through the phase adjustment between the camshafts 1 and 2.

Figure 10:
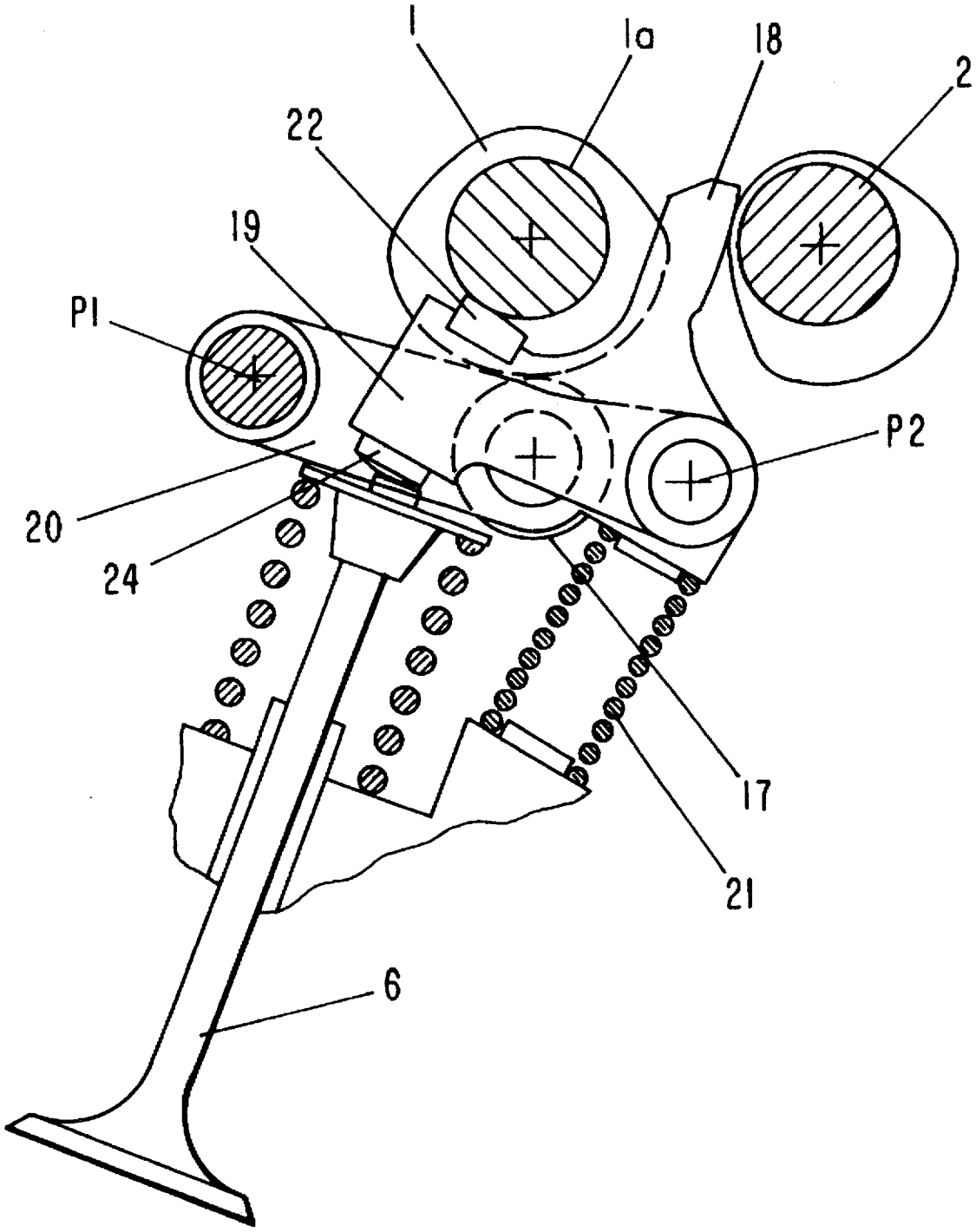

FIG. 10 illustrates an altered embodiment of FIG. 9, in which the articulated lever 20 again is mounted at P1, and for sensing the camshaft 1 as a follower 17 supports a cam roller. At P2, at the articulated lever 20 the rocker arm 19 is mounted which senses the camshaft 2 with the follower 18 and actuates the valve. The rocker arm 19 is equipped with a further follower 22 which, when the valve 6 is closed, rests on a cylinder surface 1*a* which is formed coaxially to the camshaft 1 which is the camshaft that is near the valve. The rocker arm 19 is further provided with a hydraulic valve clearance compensation element 24 which cooperates directly with the valve 6. In this embodiment the spring 21 which again is formed as a compression spring is positioned in such a way that it pushes the follower 17 into a constant contact with the camshaft 1 which preferably is the closing camshaft in which case it is guaranteed by the contact of the follower 22 with the cylinder surface 1*a* and by the valve clearance compensating element 24 that the rocker arm 19, or the valve clearance compensating element 24, constantly contacts the valve 6.

Figure 11:
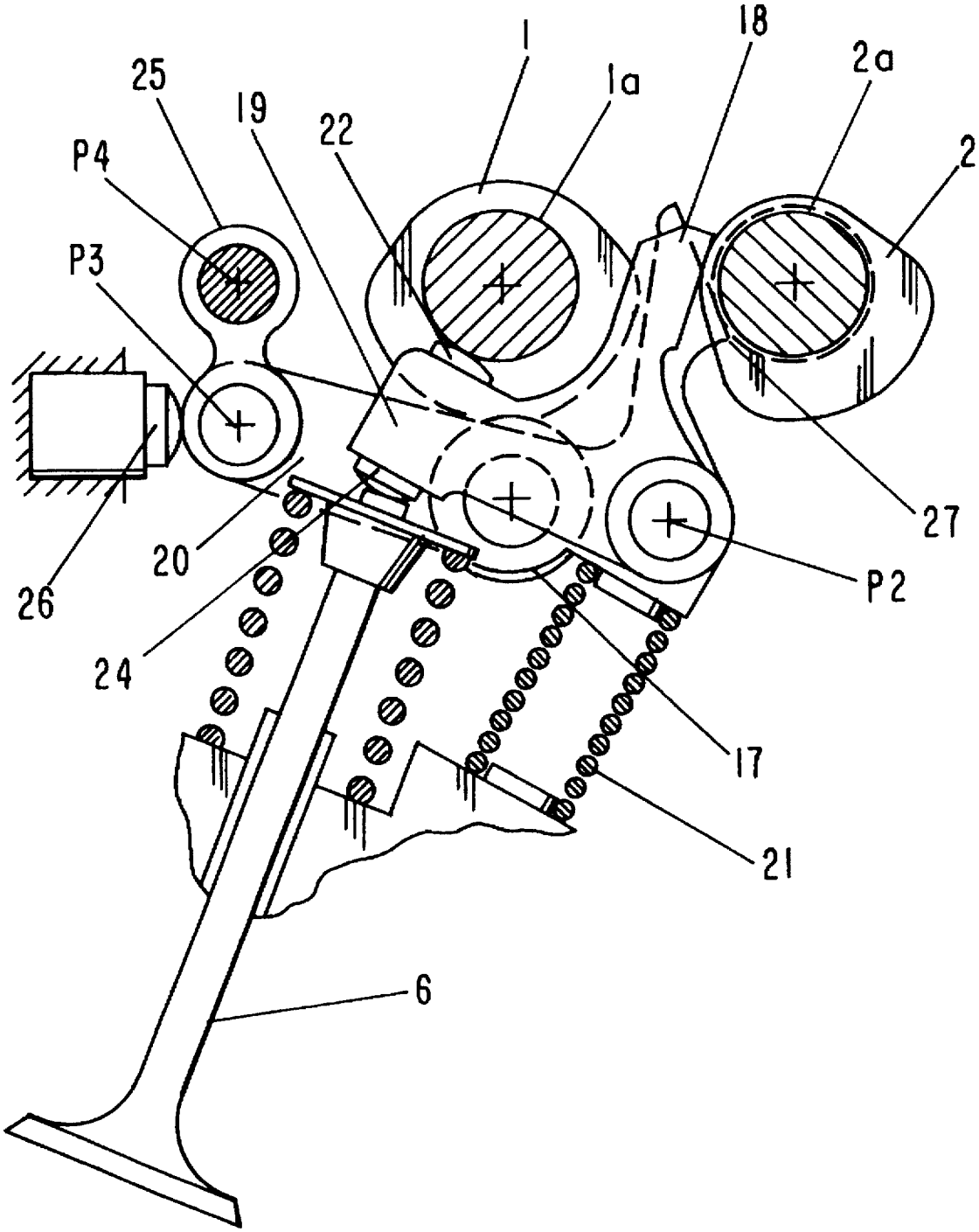

FIG. 11 illustrates a further development of the embodiment according to FIG. 10. With the embodiment according to FIG. 11 the articulated lever 20 is not supported fixedly but at P3 on another short-armed lever 25 which is mounted fixedly at P4. Between the movably guided pivotal point P3 of the articulated lever 20 and a housing a hydraulic clearance compensating element 26 acts. Furthermore the articulated lever 20 is provided with a contact surface 27 which, after the valve 6 closes, rests on a cylinder surface 2*a* which is formed on the camshaft 2. Through the described arrangement it is achieved that the clearance compensating element 26 compensates all manufacturing or operational clearances and tolerances within the valve drive. The valve clearance compensating element 24 takes care of the compensation of the direct valve clearance.

As is illustrated in FIGS. 10 and 11 the actuating of the valve is respectively carried out by the rocker arm 19 which directly cooperates with the camshaft 2. If the camshaft 2 is the opening camshaft the device according to FIGS. 10 or 11 can be further developed in such a way that if several valves 6 per cylinder unit are provided, particularly intake valves, a cam disc of the camshaft 1 which operates as the closing camshaft is provided which acts on a common articulated lever 20 and that several rocker arms 19, coaxially to P2, are supported on the articulated lever 20, each of which cooperates with a respective cam disc of the opening camshaft 2 so that the respective valve 6 can be actuated individually. The contours of the valve specific opening cam discs of the opening camshaft 2 can in this case be formed in such a way that the respective valves open at different times. By this means a specific charge movement can be produced in the combustion chamber.

It is particularly advantageous if in the case of very low valve lifts, i.e. very weak load, only a part of the valves to be actuated of each cylinder open. By this a higher resistance to tolerances is achieved. A specific swirl can be generated. Moreover the intake speed of the opening valve(s) is favorably influenced.

If the connection between the articulated lever 20 and the rocker arm 19 at the bearing location P2 can be released by a means of a switchable mechanism which is provided there the respective valve which is actuated by the rocker arm 19 can be stopped. If the articulated lever 20 is in contact with the base circle of the camshaft 1 the switch mechanism can restore the connection so that the valve can again be actuated.

Such a development of the device according to FIG. 10 is illustrated in perspective in FIG. 12:

The camshaft 1 which operates as the closing camshaft is provided with a cam disc, mostly concealed in the drawing, to actuate the articulated lever 20. Two rocker arms 19*a* and 19*b*, with the axis P2, are mounted at the articulated lever and each follow a cam disc 2*c* and 2*d*, associated therewith, and cooperate with a respective valve 6*a* and 6*b*. In this way the two valves 6*a* and 6*b* can be actuated variably controllable by three cam discs in all.

Figure 12A:
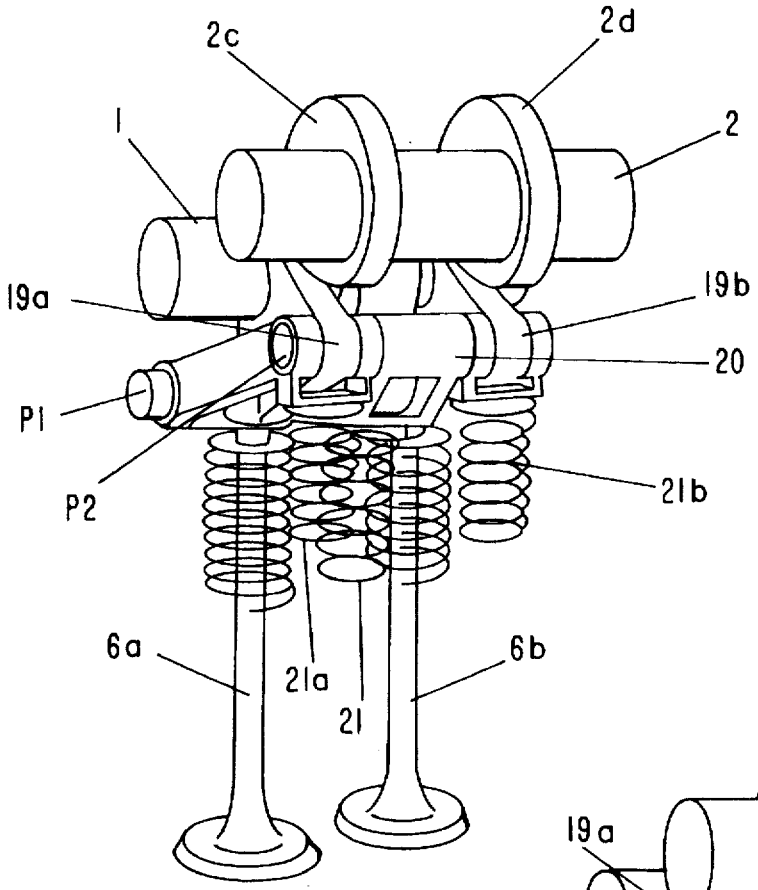

FIG. 12*a*) illustrates the device with the rocker arms 19*a* and 19*b* in a fixed support on a three-piece articulated lever 20.

Figure 12B:
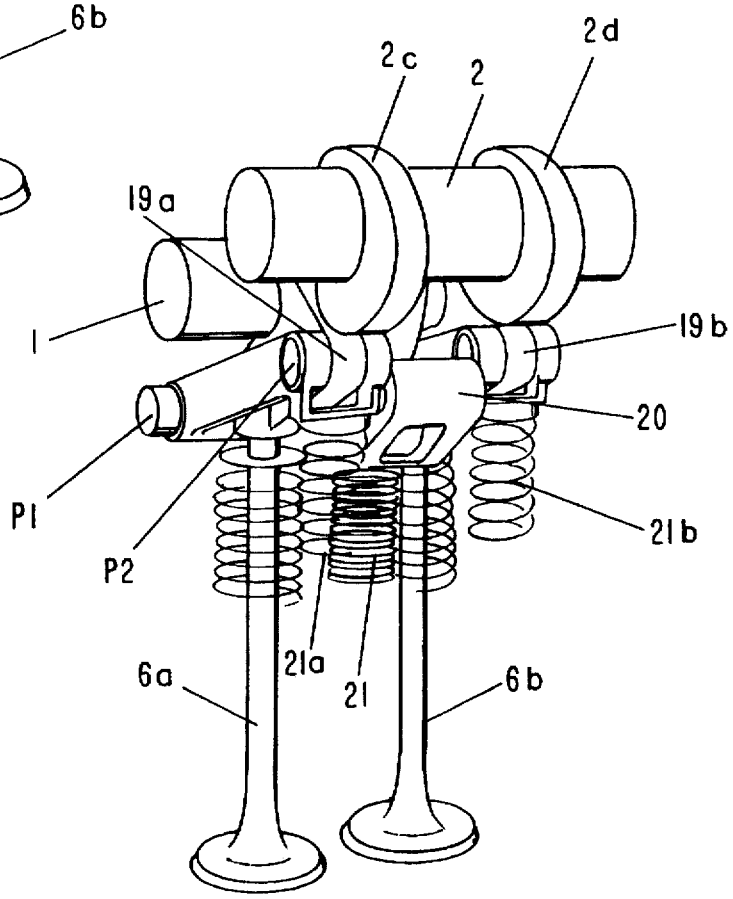

FIG. 12*b*) illustrates the device with a released support P2 effectuated by a hydraulically or electrically actuated mechanism. The articulated lever 20 is being pushed down by the lobe of the closing camshaft 1 without carrying with it the rocker arms 19*a* and 19*b* which still are articulated fixedly in P1 by the two outer parts of the articulated lever 20. In order that these remain reliably in their highest position in which no opening of the valves 6*a* and 6*b* is possible by the cam discs 2*c* and 2*d* additional compression springs 21*a* and 21*b* are provided.

As a result of the respective construction of the mechanism the rocker arms 10*a* and 19*b* can be coupled individually or only together with the articulated lever 20.

It is understood that the inventive device can also be constructed in such a way that for each valve of a cylinder respective followers and different cams on the two camshafts 1 and 2 are provided as well as corresponding transmission elements. This, however, does not allow the compact embodiment according to, for example, FIG. 12 in which case the closing cam discs are used commonly but renders a completely individual determination of the valve control timing possible.

Figure 13:
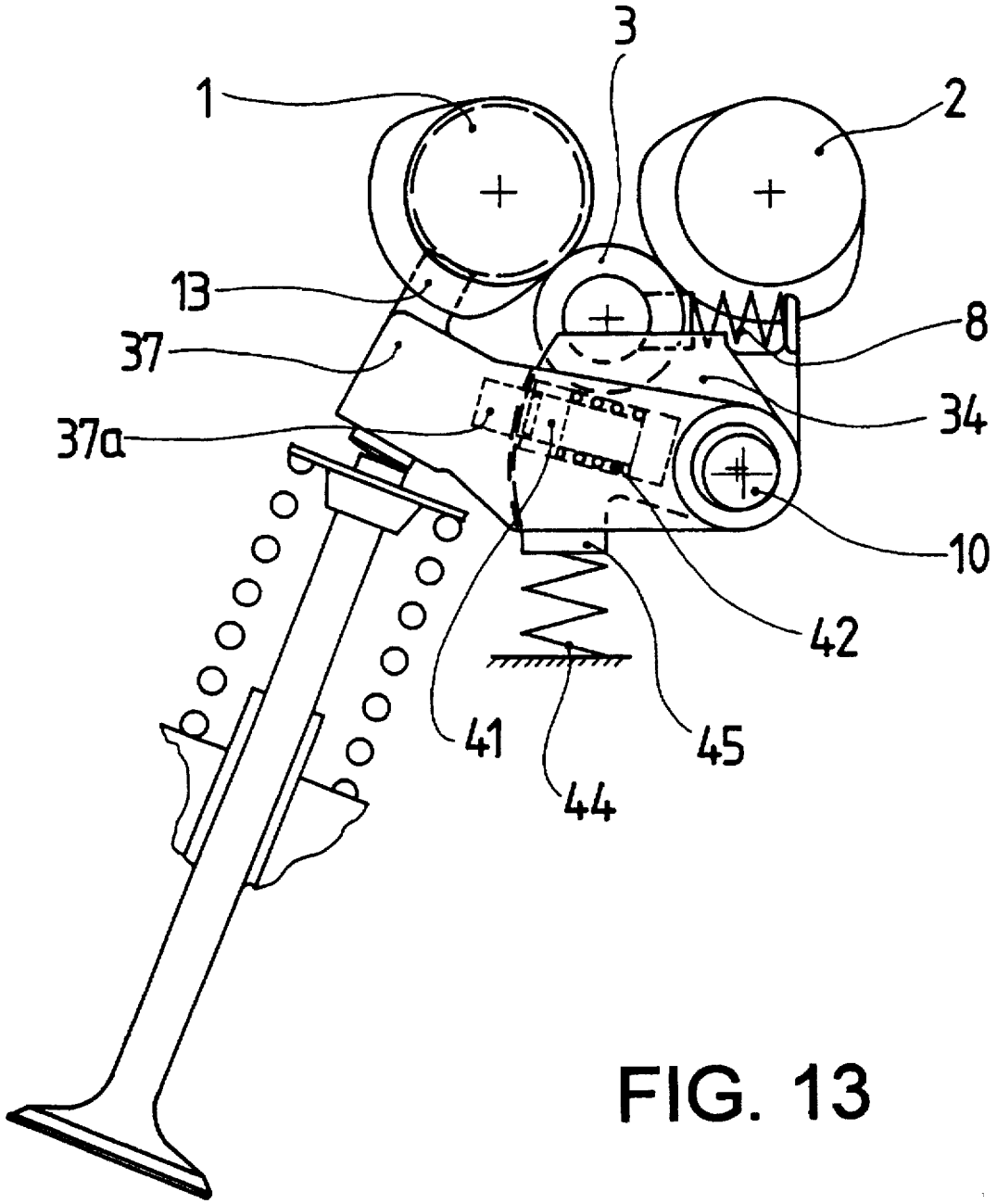
Figure 14:
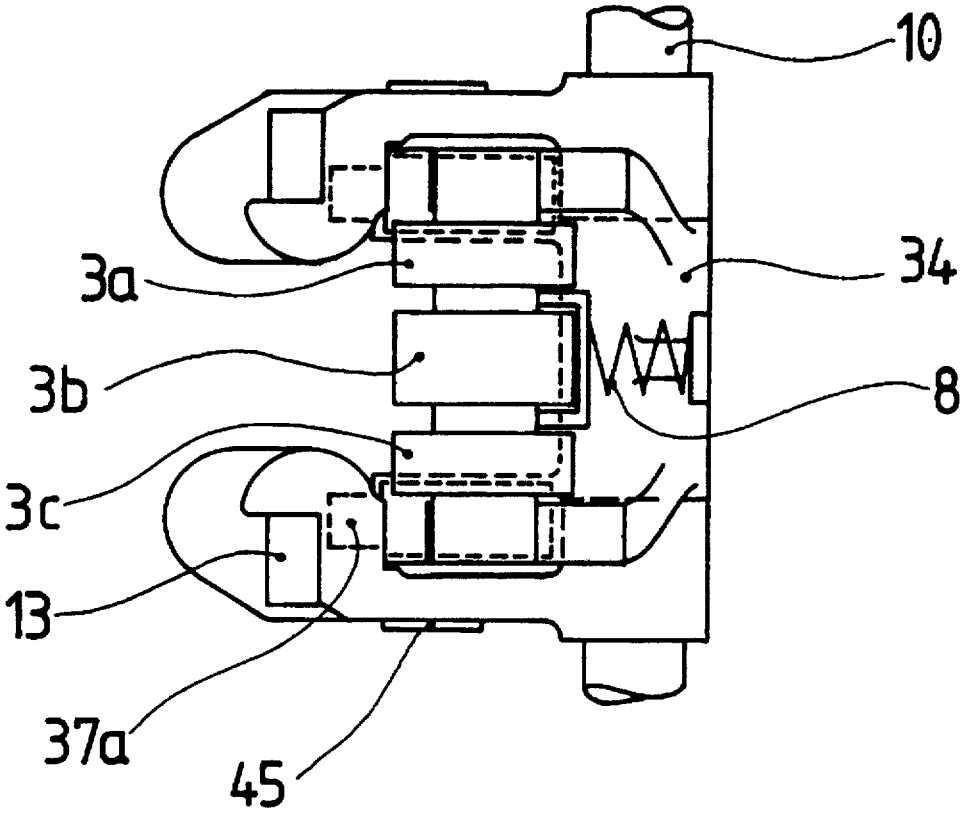

FIGS. 13 and 14 illustrate a further development of the embodiment of the invention according to FIGS. 1 and 2. In this embodiment the transmission element 4 of the embodiment according to FIGS. 1 and 2 is replaced by two transmission elements 34 and 37. To each transmission element 34 which cooperates with the follower 3 also several additional transmission elements 37 can be associated. Advantageously the additional transmission element(s) 37 can also have the form of a rocker arm in which case their fixed pivoted support at 10 is carried out on the same axis as the support of the transmission element 34. For linking or releasing the two transmission elements 34 and 37 a mechanism is provided which, for example, comprises one or several hydraulically actuated cylinder bolts 41 which are guided in one of the two transmission elements and extend by the application of a corresponding oil pressure against the force of a spring and by this run into a bore 37*a* which exists in the respectively other transmission element. In the case of a separate, multiple design of this arrangement the switching of individual valves of a cylinder unit can be staged so that at the application of a first pressure level only one cylinder bolt extends at first and the respective valve is actuated. Only when the pressure is increased to a higher pressure level a further valve is connected, and so on.

If the connection between the first transmission element 34 and the second transmission element 37 is interrupted the frictional connection between the transmission element 34 and the follower 3, i.e. the camshafts 1 and 2, during the lift movement of these parts, is guaranteed by a spring 44 which, for example, is designed as a compression spring and is supported at the housing. During the interrupted phase the position of the transmission element 34 relative to the transmission element 37 is defined by a stop 45 so that on the one hand a further upward movement of the transmission element 44 is prevented and on the other hand it is guaranteed for a switching operation that the cylinder bolt 41 runs into the boring 7*a*.

Figure 15:
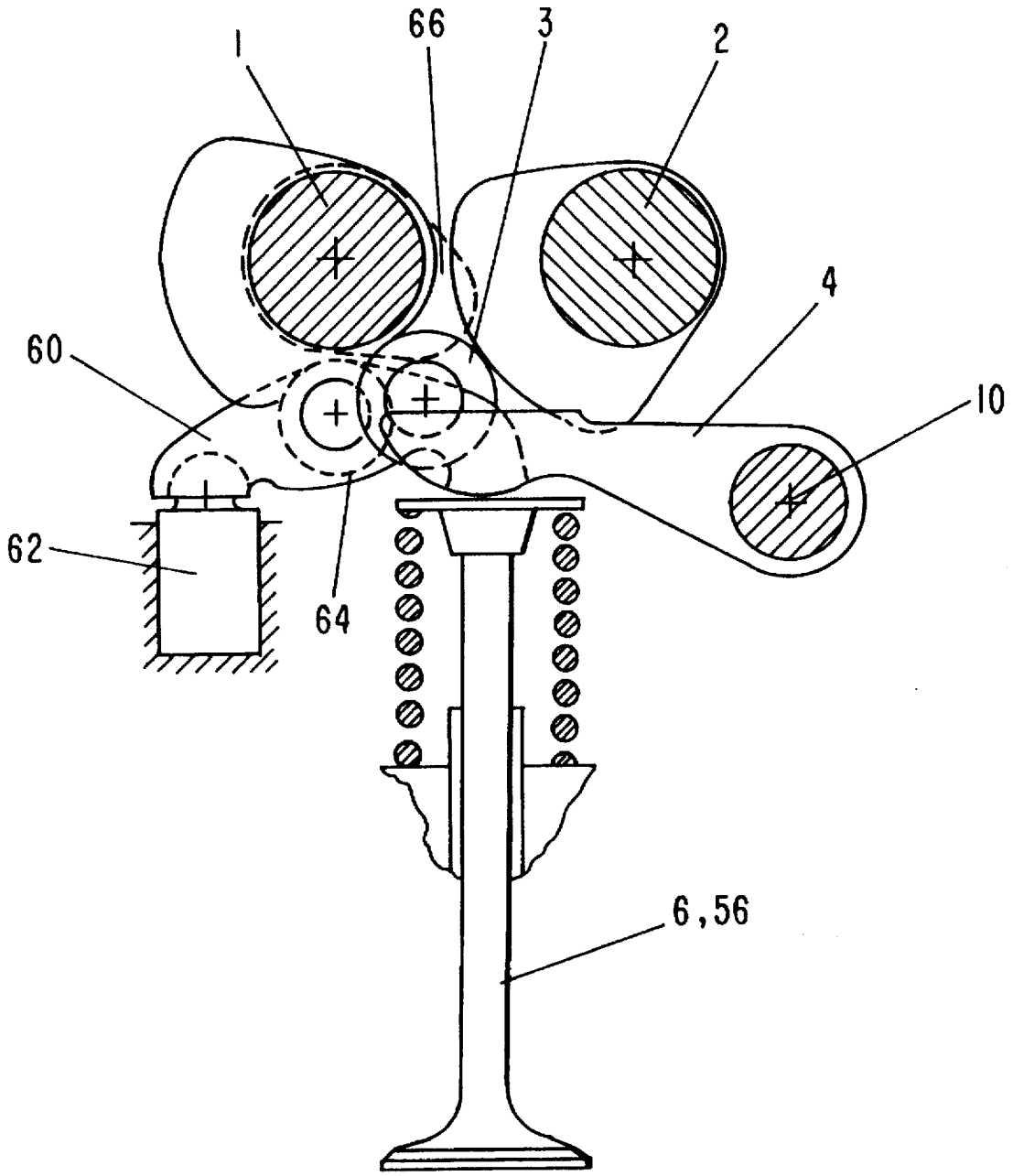

FIG. 15 illustrates a further development of FIG. 1. The valve 6 is again actuated by the transmission element on which the follower 3 is slidably supported which follows the cams of the opening camshaft 1 and the closing camshaft 2. Parallel to the axial dimension of the camshafts 1 and 2, behind the intake valve 6, an exhaust valve 56 is provided which is actuated by a lever 60, one end of which is mounted on a stationary valve clearance element 62 and the other end directly actuates the exhaust valve 56. At the lever 60 a roller 64 is supported which follows a further cam disc 66 which is mounted on the exhaust camshaft 1 and which in a manner that is known per se determines the opening and the closing of the exhaust valve. It is understood that the camshaft 1 is directly driven by the crankshaft so that a fixed relationship exists between the position of the crankshaft and the respective actuation of the exhaust valve. The mechanism which is not illustrated for driving the closing camshaft 2 and for changing its phase relationship to the opening camshaft 1 operates between these two camshafts. With the described arrangement a compact valve drive is achieved with which intake and exhaust valves of an in-line engine which advantageously are arranged successively in a single plane can be controlled in such a way that the actuation of the intake valves is fully variable and the actuation of the exhaust valves takes place in a fixedly determined relationship to the camshaft.

Figure 16:
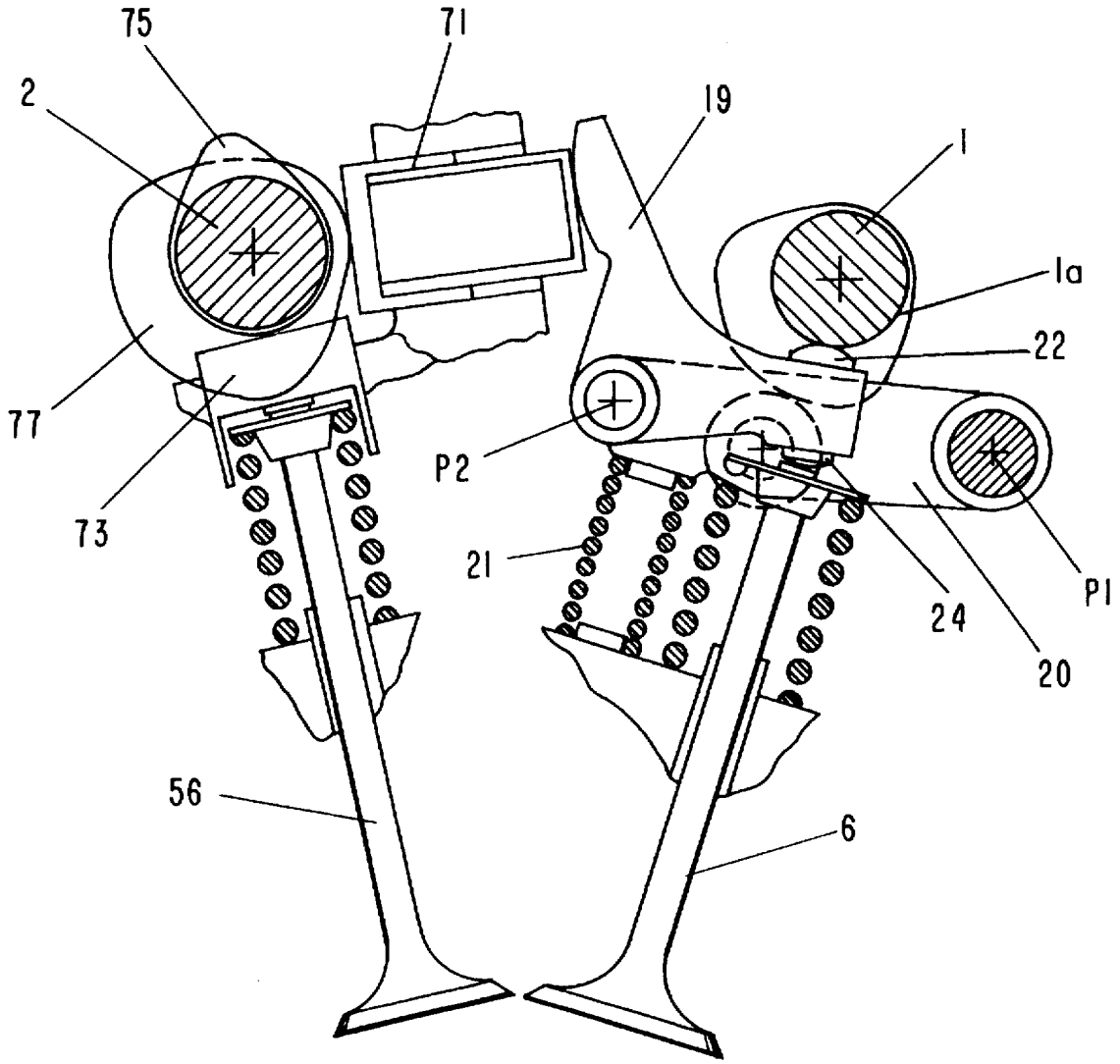

FIG. 16 illustrates a further development of the embodiment of the variable valve actuating device according to FIG. 10 with a mirror-inverted arrangement. The mechanism for the actuation of the intake valve 6 corresponds to that of FIG. 2 but the rocker arm 19 is not directly actuated by the camshaft 2 but via a tappet 71 which is stationary guided in a housing. The camshaft 2 which is the opening camshaft for the intake valve 6 additionally actuates an exhaust valve 56 via a cup tappet with an integrated hydraulic valve clearance. For this purpose the camshaft 2 is provided with two cam discs 75 and 77 and the cam disc 75 actuates the exhaust valve 56 and the cam disc 77 is the cam disc which controls the opening movement of the intake valve 6. The camshaft 2 is directly driven by the crankshaft and it drives, via an adjusting device for adjusting the phase, the camshaft 1 which is the closing camshaft for the intake valve 6. The described arrangement is appropriate for cylinders with valves that are arranged in a V-shape and there creates a compact valve drive which, in spite of the full variability of the intake valve control, only requires two camshafts.

It is understood that the adjusting device which is arranged between the two camshafts 1 and 2 can, with all of the described embodiments, be designed in a way that the intake valve 6 does not perform a lift any more. When applied to engines that have several cylinder rows a turn-off of one of the two cylinder rows can be performed in a simple way.

As a whole the invention shows a way of how particularly with Otto-motors the throttle valve can be avoided and how the power control, by reduction of the throttle losses, can be effectuated exclusively by variably actuating the intake valves.

The present invention is, of course, in no way restricted to the specific disclosure of the specification and drawings, but also encompasses any modifications within the scope of the appended claims.

We claim:

1. A method for a variable control of a valve of an internal combustion engine, said method including the steps of:

sensing cam contours of two camshafts, which normally rotate at the same speed, via a follower in the manner of an adder;

transmitting the movement of said follower to said valve via an actuating means for actuating said valve;

providing one of said camshafts as an opening camshaft having a cam with a base circle portion that merges via an opening portion with a lobe;

providing the other of said camshafts as a closing camshaft having a cam with a lobe that merges via a closing portion with a base circle portion;

varying a phase relationship between said camshafts to vary at least one of a lift and an opening duration of said valve;

after closure of said valve, holding said follower in contact with said cam of only one of said camshafts, while said cam of the other of said camshafts moves out of contact with said follower and again comes into contact with said follower at the latest at the beginning of opening of said valve; and when said valve is in a closed state, holding said actuating means substantially in contact with said valve.

2. An apparatus for the variable control of a valve of an internal combustion engine, comprising:

two camshafts that normally rotate at the same speed, said camshafts being provided with respective cams, wherein said cam of one of said camshafts that operates as an opening camshaft is provided with a base circle portion that merges via an opening portion with a lobe, and wherein said cam of the other of said camshafts that operates as a closing camshaft is provided with a lobe that merges via a closing portion with a base circle portion;

follower means for sensing contours of said cams of said camshafts in the manner of an adder;

an actuating means for transmitting movement of said follower means to said valve for actuating said valve;

means for varying a phase relationship between said camshafts to vary at least one of a lift and an opening duration of said valve;

spring means for holding said follower means, after closure of said valve, in contact with said cam of only one of said camshafts; and means for holding said actuating means, when said valve is in a closed state, substantially in contact with said valve.

3. An apparatus according to claim 2, wherein after closure of said valve said spring means holds said follower means in contact with said cam of said opening camshaft.

4. An apparatus according to claim 2, wherein said follower means comprises a follower element for the common sensing of said contours of said cams of both of said camshafts, which are disposed parallel to one another, and wherein said follower element is movably guided on a transmission element of said actuating means, with said follower element being guided in a plane that extends perpendicular to center lines of said camshafts.

5. An apparatus according to claim 4, wherein said transmission element is a rocker arm, and wherein said follower element is movably guided in one of the following ways, namely in a translatory manner on linear slideways of said transmission element, or in a rotatable manner on curved guideways or on a pivotably mounted rocker arm.

6. An apparatus according to claim 4, wherein said follower element comprises three rollers that are mounted on a common pin, including two outer rollers that cooperate with two identical cams of said one camshaft, and an inner roller that cooperates with a cam of said other camshaft.

7. An apparatus according to claim 4, wherein said two camshafts are spaced apart such that travel circles of cams of said camshafts overlap one another, with said cams being axially offset such that they do not contact one another.

8. An apparatus according to claim 4, wherein that camshaft that is closest to said valve is provided with a cylindrical surface that is coaxial to said cam shaft, and wherein a stop means is disposed on said cylindrical surface to define a position of said transmission element when said valve is closed.

9. An apparatus according to claim 8, wherein a valve clearance compensation element is disposed between said transmission element and said valve that is actuated thereby.

10. An apparatus according to claim 4, wherein said transmission element is provided with a support means that is continuously adjustable for the compensation of manufacturing tolerances.

11. An apparatus according to claim 4, wherein after closure of said valve, said transmission element is respectfully supported on cylinder surfaces coaxially formed on said camshafts, and wherein at the same time a valve clearance compensating element disposed in a stationary pivot point of said transmission element compensates for all manufacturing and operational clearances and tolerances of a valve mechanism.

12. An apparatus according to claim 11, wherein an additional stop element is provided to effect support against said cylinder surface of one of said camshafts, with said additional stop element being coaxially articulated on the other of said camshafts.

13. An apparatus according to claim 12, wherein in order to support said transmission element against said cylinder surface of said one camshaft, said additional stop element is provided with a circular member, the diameter of which corresponds approximately to that of said follower element and which is supported on a slideway of said follower element on said transmission element, and wherein the support diameter of said stop element against said other camshaft corresponds to the base circle of said other camshaft while the diameter of said cylinder surface of said one camshaft corresponds to the base circle of said one camshaft.

14. An apparatus according to claim 2, wherein said follower means and said actuating means are provided with at least one articulated lever that is in the form of a rocker arm and senses said contour of said cam of said one camshaft, and at least one pivot lever that is in the form of a rocker arm and senses said contour of said cam of the other camshaft, with said pivot lever having a pivot point disposed on said articulated lever, and wherein one of said levers, after closure of said valve, is held by said spring means against said cam of a pertaining one of said camshafts while said cam of the other camshaft, after closure of said valve, is out of contact with the other lever and at the beginning of opening of said valve again comes into contact against said last-mentioned lever.

15. An apparatus according to claim 14, wherein after closure of said valve said pivot lever is supported against a cylinder surface that is coaxially formed on that camshaft that is closest to said valve.

16. An apparatus according to claim 15, wherein a valve clearance compensating element is provided in said pivot lever and effects compensation of clearance between a shaft of said valve and said pivot lever.

17. An apparatus according to claim 15, wherein after closure of said valve said articulated lever is supported on a cylinder surface coaxially formed on the other camshaft, while at the same time a clearance compensating element that acts upon a movably guided pivot point of said articulation lever compensates all remaining manufacturing and operational clearances and tolerances within a valve drive.

18. An apparatus according to claim 17, wherein said movably guided pivot point is pivoted about a fixed point.

19. An apparatus according to claim 14, for engines having two or more valves per cylinder that are to be actuated, wherein a common articulated lever is provided that is fixedly articulated, wherein a common closing camshaft is provided for actuating said articulated lever, and wherein separate pivot levers are provided that are associated with the respective valve and that are actuated by correspondingly separate opening camshafts that are associated with the respective valves.

20. An apparatus according to claim 19, wherein said valve specific opening camshafts are provided with cams such that the associated valves operate in at least one of the following ways, namely opening at different times and with different lift movements.

21. An apparatus according to claim 20, wherein where very small valve lifts are involved, only a portion of said valves per cylinder that are to be actuated open.

22. An apparatus according to claim 19, wherein a switchable mechanical connection is provided between said articulated lever and said pivot lever, which is in the form of a rocker arm, with said mechanical connection serving for idling a pertaining valve.

23. An apparatus according to claim 4, wherein for each valve of a cylinder its own transmission element and its own follower elements and different cams on said two camshafts are provided.

24. An apparatus according to claim 4, wherein a further transmission element and a switchable, mechanical connection between said first mentioned transmission element and said further transmission element are provided to thereby be able to idle a pertaining valve.

25. An apparatus according to claim 22, wherein a hydraulically actuatable mechanism is provided for switching of said mechanical connection.

26. An apparatus according to claim 24, wherein a hydraulically actuatable mechanism is provided for switching of said mechanical connection.

27. An apparatus according to claim 25, wherein a hydraulic system having different pressure levels is provided for realizing different switching states of said mechanical system.

28. An apparatus according to claim 26, wherein a hydraulic system having different pressure levels is provided for realizing different switching states of said mechanical system.

29. An apparatus according to claim 2, wherein for engines having more than one row of cylinders, at least one row of cylinders can be idled via a phase relationship of said two camshafts that is appropriate for a zero lift.

30. An apparatus according to claim 2, wherein one of said camshafts, namely the opening camshaft, is provided with cams for a variable control of valves, and further cams for actuating additional valves, namely exhaust valves, are provided on a common shaft.

31. An apparatus according to claim 30, wherein said valves that are additionally to be actuated, and said variably controlled valves, are disposed in a common plane parallel to a longitudinal axis of an engine.

32. An apparatus according to claim 30, wherein said valves that are additionally to be actuated, and said variably controlled valves, are disposed in different planes parallel to a longitudinal axis of an engine.

33. An apparatus according to claim 30, wherein said valves that are additionally to be actuated are actuated from said common camshaft via rocker arms.

34. An apparatus according to claim 32, wherein said valves that are additionally to be actuated are directly actuated from said common camshaft via cup tappet means, and said apparatus is actuated from said common camshaft via an intermediate element, such as a push rod.

* * * * *